US011414248B2

(12) United States Patent
Krajewski

(10) Patent No.: US 11,414,248 B2
(45) Date of Patent: Aug. 16, 2022

(54) DISPENSER WITH A MEMBRANE FOR SACHETS

(71) Applicant: Dariusz Jerzy Krajewski, Massagno (CH)

(72) Inventor: Dariusz Jerzy Krajewski, Massagno (CH)

( * ) Notice: Subject to any disclaimer, the term of this patent is extended or adjusted under 35 U.S.C. 154(b) by 0 days.

(21) Appl. No.: 17/089,643

(22) Filed: Nov. 4, 2020

(65) Prior Publication Data

US 2021/0070511 A1 Mar. 11, 2021

Related U.S. Application Data

(63) Continuation of application No. 16/471,556, filed as application No. PCT/IB2017/058134 on Dec. 19, 2017, now abandoned.

(51) Int. Cl.

| | |
|---|---|
| ***B65D 47/20*** | (2006.01) |
| ***B65D 75/58*** | (2006.01) |
| *B65D 83/00* | (2006.01) |

(52) U.S. Cl.

CPC ..... *B65D 47/2031* (2013.01); *B65D 75/5883* (2013.01); *B65D 83/0055* (2013.01); *B65D 2575/583* (2013.01); *B65D 2575/586* (2013.01)

(58) Field of Classification Search

CPC ..... B65D 47/2031; B65D 75/5883; B65D 2575/586; B65D 2575/583; B65D 83/0055

USPC .... 222/545, 529, 92, 105, 107, 527; 383/42, 383/43, 51, 80; 220/703

See application file for complete search history.

(56) References Cited

U.S. PATENT DOCUMENTS

| | | | | |
|---|---|---|---|---|
| 2008/0247684 | A1* | 10/2008 | Binks | B65D 49/02 383/113 |
| 2015/0147430 | A1* | 5/2015 | Dzikowicz | B65D 47/30 426/2 |
| 2016/0318684 | A1* | 11/2016 | Jo | B65D 41/04 |
| 2017/0066571 | A1* | 3/2017 | Panec | B65D 47/2031 |

FOREIGN PATENT DOCUMENTS

| | | | |
|---|---|---|---|
| WO | WO 2017/052364 | A1 * | 3/2017 |
| WO | WO 2020/111939 | A1 * | 6/2020 |

* cited by examiner

*Primary Examiner* — Lien M Ngo

(74) *Attorney, Agent, or Firm* — Andrzej Malarz, Esq.

(57) ABSTRACT

The dispenser with a membrane for sachets is characterised by the fact that the pouring nozzle has an upper region made of a thermoplastic elastomer, forming a monolith with the rest of the body of the dispenser, and the said pouring nozzle is equipped in the upper region with an elastic partition forming a membrane with a pair of intersecting slits.

20 Claims, 5 Drawing Sheets

DISPENSER WITH A MEMBRANE FOR SACHETS

This application is a continuation-in-part application of the pending U.S. patent application Ser. No. 16/471,556, filed on Jun. 19, 2019, and claims a priority of Polish Application P.419871, which contents are incorporated in their entirety into the present application for all purposes.

The present invention relates to a dispenser with a membrane for sachets especially designed for permanent connection with a plastic container with flexible walls for dispensing products, especially liquid edible products for children or household goods.

PL362809 describes a cap for closing containers with a dispenser, characterized in that it consists of a main cap and threaded cap with a dispenser. The main cap consists of a cylindrical part equipped with an external thread, the main cap having an inner ring and a buffer collar. The threaded cap has an inner cylindrical portion, an inner ring positioned concentrically and an internal thread. The dispenser is an internal cylindrical part in which a cylindrical insert with a flat bottom with an external flange is inserted.

From the description of the invention PL202697, a liquid product dispensing head is known to be connected to a container containing a liquid product, said head comprising a fixed base formed by said container or mounted on it a rotatable actuator mounted rotationally on a base around the axis of rotation between the two end stop positions and the dispensing opening selectively sealed by rotating the element on the base. The invention is characterized in that both end stop positions define two positions of opening the dispensing opening separately through at least one closed position of the dispensing opening and in that the dispensing opening is situated on the axis of rotation of the elements at the base.

PL212343 describes a closure cap with a dispenser for containers, known as a fliptop closure, characterized in that in the cap extending from the bottom part, in the opposite direction to the interior of the container, an outlet nozzle with outlet opening is formed in the dispenser flange, wherein a shutter in the form of a plate, preferably circular, is formed at the bottom of this outlet opening connected by ribs, and in addition there are inlet channels connecting the outlet channel with the slots around the shutter. The center of symmetry of the dispenser is preferably eccentric with respect to the axis of symmetry of the bottom part of the cap.

PL180362 describes a slot valve for closing containers made in the form of a ready-to-use product, comprising a membrane made of a thermoplastic elastomer of rubber-like and elastic properties and integrally joined with a thermoplastic body other than a thermoplastic elastomer of the membrane using a twocomponent injection-molding method. The membrane can have selected dimensions that the slitted pouring opening opens when a certain pressure limit is exceeded which is greater than the pressure of the liquid being sealed in the container.

From the description of the utility model RU58871 a dispenser with a protective cap is known having a cone-shaped body, whose pouring opening is topped with a cap connected by means of peelable bridges with a flange. The outer surface of the bottom part of the body is equipped with a system of thinwalled ribs finished with a flexible wing.

WO2008050361 describes a container cap with a warranty seal, which breaks after the first opening. The container cap can be rotated by the user. The warranty seal, on the other hand, is integral with the handling elements and consists of a plurality of segments, the seal having a coupling portion that has at least one coupling element for engaging the stop elements and a connecting portion to prevent rotation of the warranty seal. The cap is characterized in that the replaceable warranty seal further comprises a securing portion that allows coupling of the engaging portion with the handling portion. The securing portion is structurally suitable for retaining the engaging portion and limited by breaking the seal.

From the description of the invention WO2014007612, a closure assembly and a container provided with a closure assembly is known. The assembly consists of a cylindrical neck with a channel forming an outlet in the upper part of this channel. In the upper part of the cylindrical neck, a rotating cap is mounted, adapted to manually rotate from the closed position in the direction of opening.

The cap comprises a tamper-evident ring in form of a breakable bridge composed of at least two ring segments, each ring segment having a base portion and an indicator portion. The cap with a tamper-evident ring is designed such that when the cap is rotated in the direction of the opening from its closed position, for the first time, the end of the indicator portion enters the recess of the catch portion which then prevents further rotation in the opening direction. The breakable bridge between the head of the base portion and the indicator portion undergoes permanent deformation upon further rotation in the opening direction.

The essence of the dispenser with a membrane for sachets, according to the invention, is that the pouring nozzle has an upper region made of thermoplastic elastomer or liquid silicone rubber, forming a monolith with the rest of the body of the dispenser, which below the upper region and at the top is made of polyethylene or polypropylene, preferably from renewable sources. The pouring nozzle is equipped in the upper region with an elastic partition forming a membrane with a pair of intersecting slits extending radially outwards, wherein the membrane is made of a thermoplastic elastomer or liquid silicone rubber. The dispenser is made by a multi-component injection-molding process.

The advantage of a dispenser with a membrane for sachets is by obtaining the optimal parameters of use, where the pouring nozzle has a soft, elastically flexible side surface and is resistant to possible breaking or biting by children. The invention facilitates the dosing of the product out of the container. The advantage is also the obtained optimal tightness parameters when the container falls, as well as when opening maintaining a proper distance against excessive turning, which otherwise leads to damage to the dispenser and/or membrane. It is also beneficial by lengthening the dates for consumption of liquid products stored in containers with this dispenser.

The subject of the invention is shown in the drawing, in which.

Figure 1:
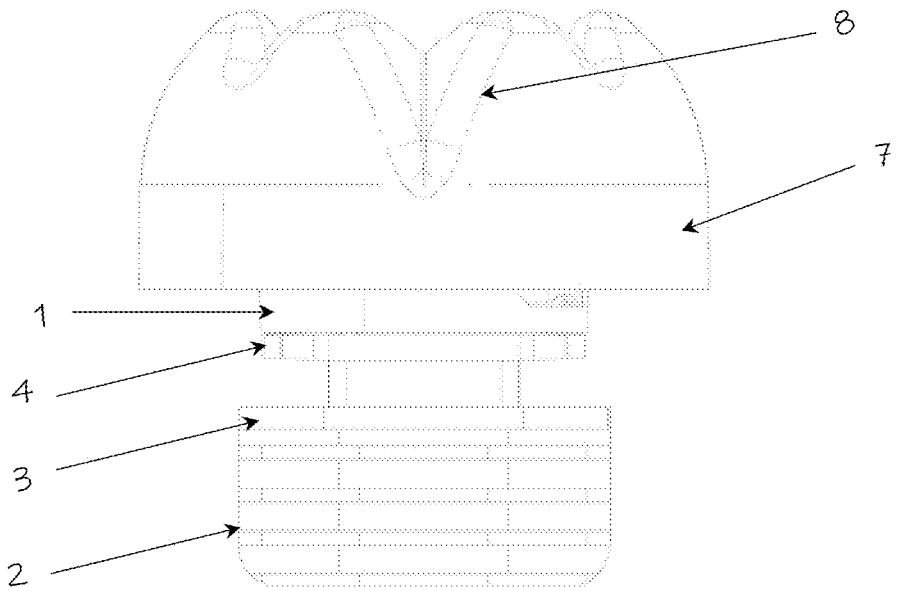
FIG. 1 shows the dispenser and a membrane in front view.
Figure 2:
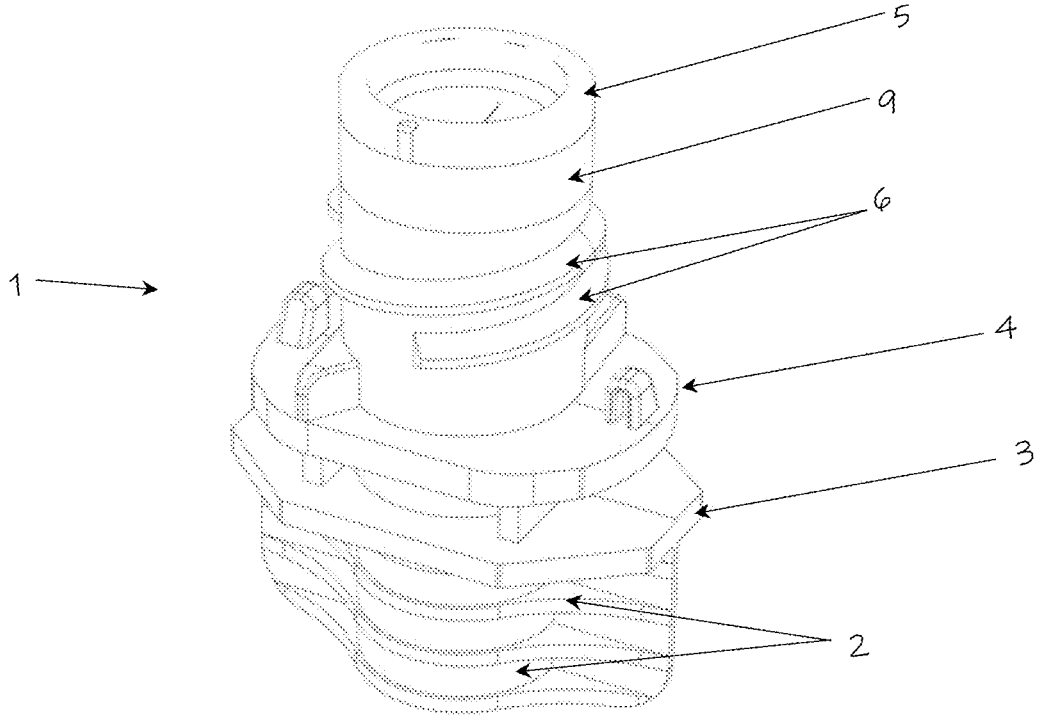
FIG. 2 shows the body of the dispenser in perspective view.
Figure 3:
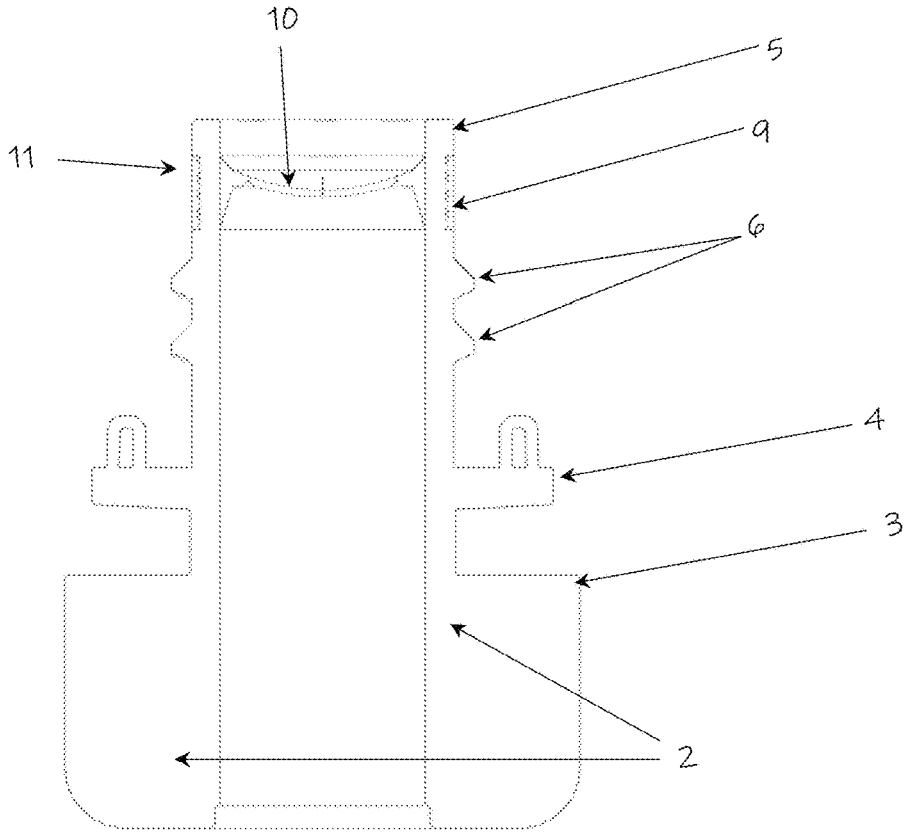
Figure 4:
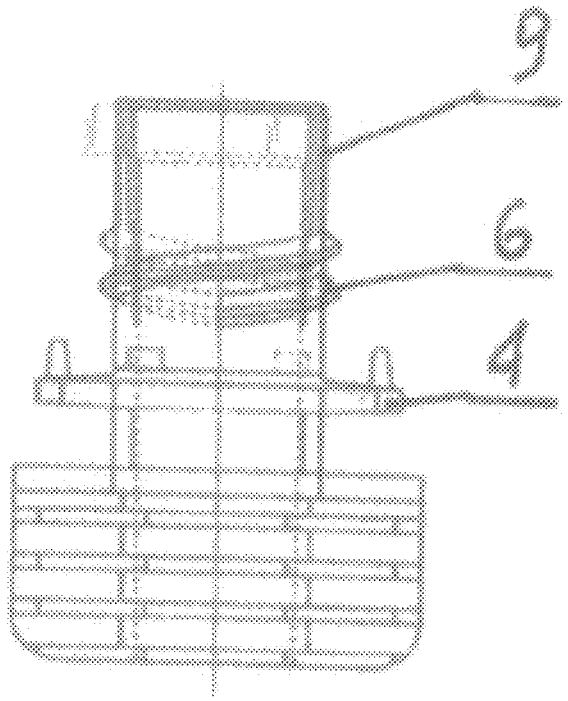
Figure 5:
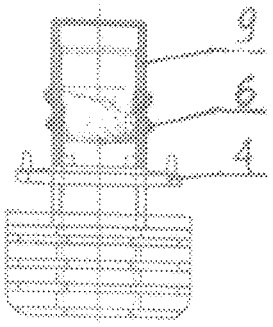
Figure 6:
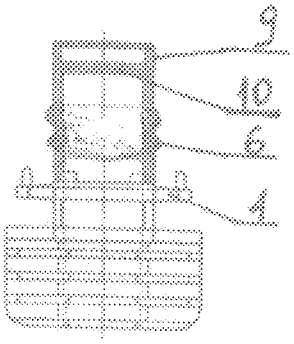
Figure 7:
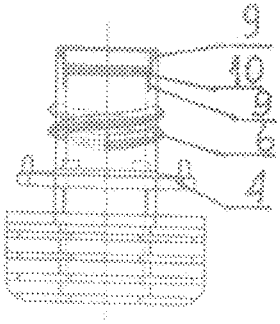
Figure 8:
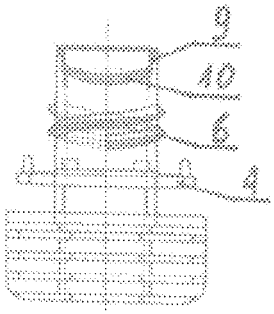
Figure 9:
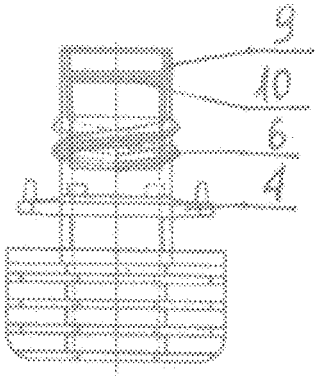
Figure 10:
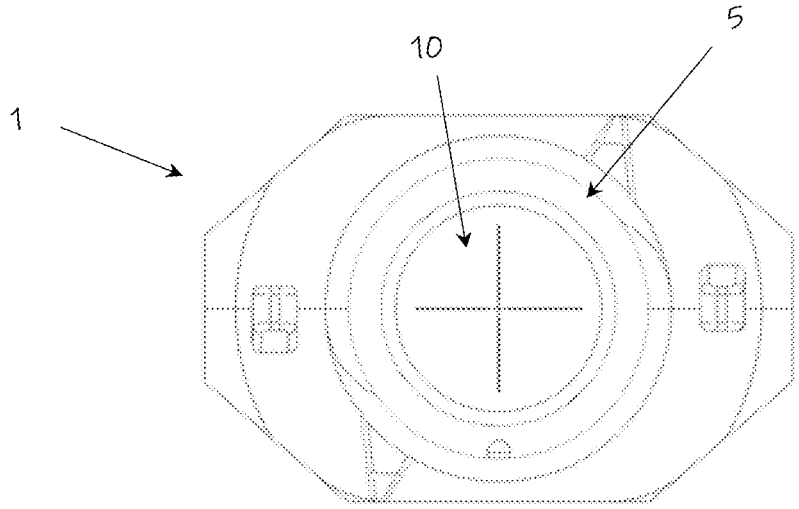
Figure 11:
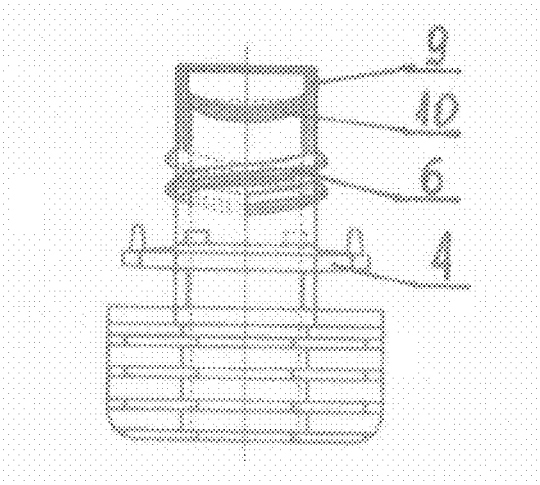

FIG. 3 shows the body of the dispenser in a partial cross section with a membrane of a concave meniscus in front view, FIG. 4 shows the body of the dispenser in a partial cross section in a different variant of the top region and a circular overlay of the inner surface in front view, FIG. 5 shows the body of the dispenser in a partial cross section in another variant of the top region appointed above the upper shelf in front view, FIG. 6 shows the body of the dispenser in a partial cross section with a flat membrane in front view, FIG. 7 shows the body of the dispenser in a partial cross section in a different variant of the top region and a circular overlay of the inner surface and a flat membrane in front view, FIG. 8 shows the body of the dispenser as on FIG. 7, but with a membrane of a concave meniscus in front view, FIG. 9 shows the body of the dispenser in another variant with the top region appointed above the screw threads, and with a flat membrane in front view, FIG. 10 shows the body of the dispenser in top view, FIG. 11 shows the body of the dispenser as on FIG. 9, but with a membrane of a concave meniscus in front view.

Figure 12:
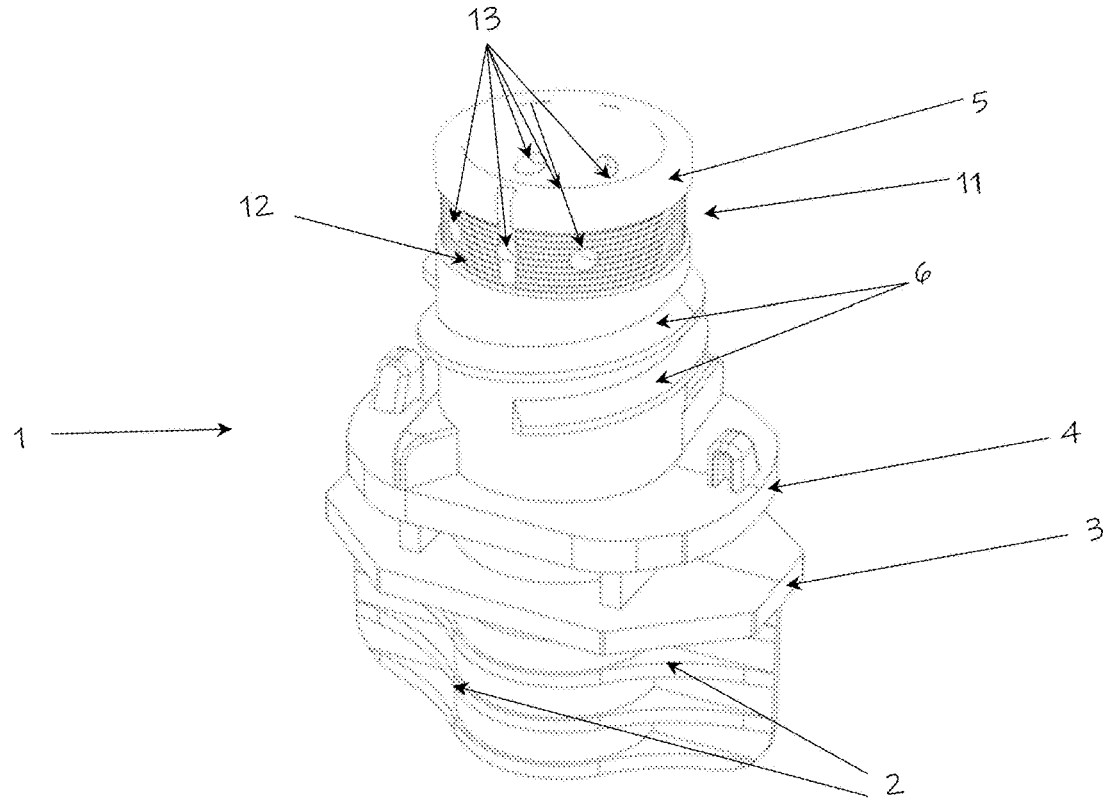

FIG. 12 shows the body of the dispenser without the thermoplastic/LSR material, in perspective view.

Figure 13:
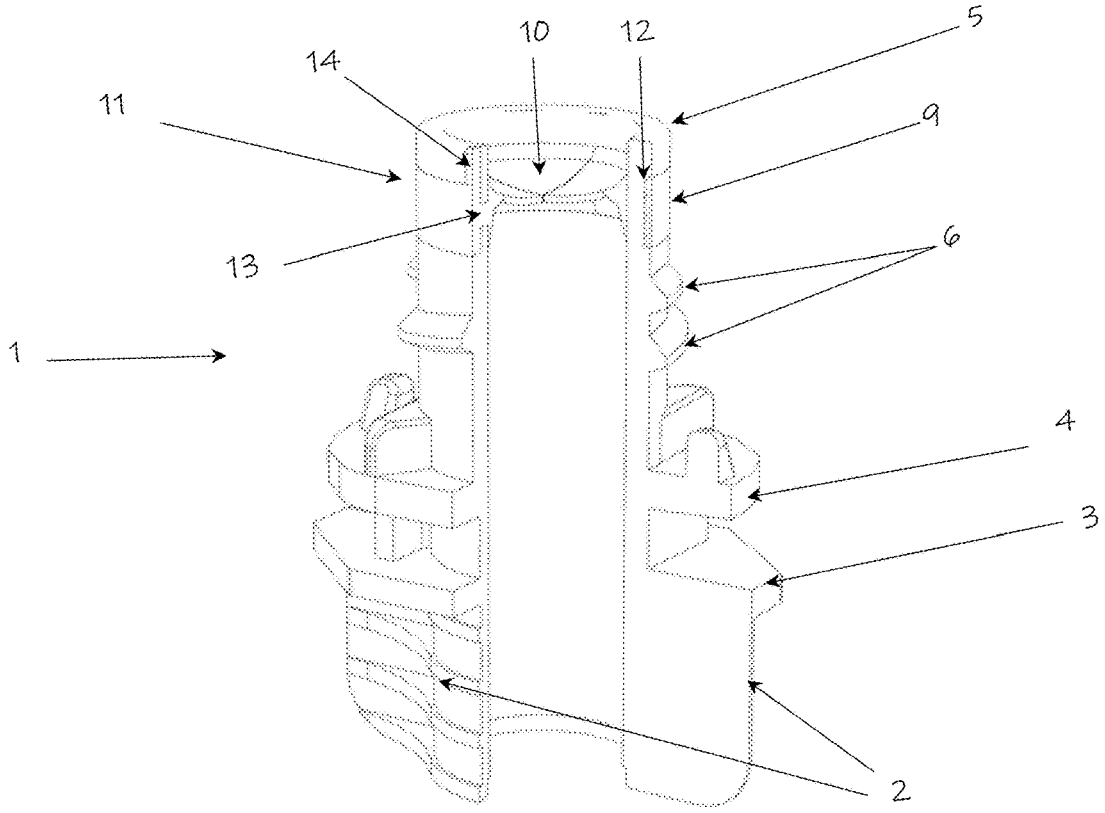

FIG. 13 shows the body of the dispenser in partial cross section in perspective view.

The dispenser with a membrane for sachets is made of plastic and is designed for permanent connection with a plastic container with flexible walls, such as sachets for fruit juice, fruit or vegetable puree, detergents, etc.

The dispenser with a membrane for sachets, has a body 1 with an outer surface shaped with a tube-like outline, having a weldable portion 2, and above it the lower shelf 3, the upper shelf 4 and a pouring nozzle 5.

The lateral surface of the pouring nozzle 5 has a screw thread 6 and mounted is a removable membrane 7 with a covering element having a profiling cup 8 on the upper part.

The pouring nozzle 5 has a region 9 made of thermoplastic elastomer above the screw threads 6 in the upper region, and a top region 15. The upper region 9 forms a monolith with the rest of the body 1 of the dispenser, which below the upper region 9 and in the top region 15 is made of polyethylene or polypropylene. In the dispenser, in the variant of the invention shown in FIG. 3, the pouring nozzle 5 has the upper region 9 above the screw thread 6.

The body of the dispenser 1, in another variant shown in FIG. 4 has an elastic top region 9 appointed above the screw thread 6 with a circular overlay of the inner surface made of a thermoplastic elastomer.

The body of the dispenser in the variant shown in FIG. 5 has an elastic top region 9 above the upper shelf 4.

The body of the dispenser in the variant shown in FIG. 6 has a pouring nozzle 5 wherein the internal part of the upper region 9 is equipped with an elastic, flat partition forming a membrane 10 with a pair of intersecting slits extending radially outwards. The membrane 10 is made of a thermoplastic elastomer or liquid silicon rubber.

The body of the dispenser in the variant shown in FIG. 7 has a region with a circular overlay of the inner surface made of a thermoplastic elastomer and contains a flat membrane 10.

The body of the dispenser in the variant shown in FIG. 8 has a top region with a circular overlay of the inner surface made of a thermoplastic elastomer or liquid silicone rubber and contains a membrane 10 of a concave meniscus.

The body of the dispenser in the variant shown in FIG. 9 has an elastic top region 9 appointed above the screw thread 6 with a circular overlay of the inner surface made of a thermoplastic elastomer and contains a flat membrane 10.

The body of the dispenser in the variant shown in FIG. 11 has an elastic top region 9 appointed above the screw thread 6 with a circular overlay of the inner surface and contains a membrane 10 of a concave meniscus.

The body of the dispenser shown in FIG. 12 contains no second material (thermoplastic elastomer or liquid silicone rubber) and has caveats/depressions 11 situated on the external side of the nozzle 5 in the upper region but below the top region 15. The caveat has creases/bumbs 12 that pose a larger surface area than if the creases were not present by a factor of at least 1. The caveat contains at least one perforation 13 through the entire wall thickness.

The body of the dispenser shown in FIG. 13 has caveats/depressions 11 situated on the external side of the nozzle 5 in the upper region but below the top region 15. The caveat has creases/bumbs 12 that pose a larger surface area than if the creases were not present by a factor of at least 1. The caveat contains at least one perforation 13 through the entire wall thickness. The second material in form of thermoplastic elastomer or liquid silicone rubber bonds with the first material polyethylene or polypropylene in the area of the caveat and perforation. Moreover the dispenser contains a vertical channel 14 connecting the elastic upper region with the top of the dispenser.

The invention claimed is:

1. A dispenser with an elastic membrane for sachets made of plastic designed for permanent connection with a plastic container with flexible walls, for fruit juice, puree, and other edible and nonedible liquids, comprising a body with an outer surface shaped with a tube-like outline, having a weldable portion and above it a lower shelf, an upper shelf and a pouring nozzle, wherein the lateral surface of the pouring nozzle has a screw thread and mounted is the elastic membrane with a covering element having a profiling cup on an upper part, wherein the pouring nozzle has a region made of thermoplastic elastomer forming the elastic membrane above the screw threads in an upper region, wherein the upper region forms a monolith with the rest of the body of the dispenser, which below the upper region is made of polyethylene, wherein the pouring nozzle has the upper region above the screw thread; wherein the body of the dispenser comprises caveats/depressions situated on the external side of the pouring nozzle in the upper region but below the tip, wherein the caveat has creases/bumps that pose a larger surface area than if the creases were not present by a factor of at least 1, wherein the caveat contains at least one perforation through the entire wall thickness.

2. The dispenser with the elastic membrane for sachets, according to claim 1, wherein the body of the dispenser comprises an elastic top region appointed above the screw thread with a circular overlay of an inner surface made of a thermoplastic elastomer.

3. The dispenser with the elastic membrane for sachets, according to claim 1, wherein the body of the dispenser comprises the elastic top region above the upper shelf.

4. The dispenser with the elastic membrane for sachets, according to claim 1, wherein the body of the dispenser comprises the pouring nozzle, wherein the internal part of the upper region is equipped with an elastic, flat partition forming the elastic membrane with a pair of intersecting slits extending radially outwards, wherein the elastic membrane is made of a thermoplastic elastomer or liquid silicon rubber.

5. The dispenser with the elastic membrane for sachets, according to claim 1, wherein the body of the dispenser comprises a region with a circular overlay of the inner surface made of a thermoplastic elastomer and contains the elastic membrane.

6. The dispenser with the elastic membrane for sachets, according to claim 1, wherein the body of the dispenser comprises the elastic top region with a circular overlay of the inner surface made of a thermoplastic elastomer and contains the elastic membrane of a concave meniscus.

7. The dispenser with the elastic membrane for sachets, according to claim 1, wherein the body of the dispenser comprises the elastic top region appointed above the screw thread with a circular overlay of the inner surface made of a thermoplastic elastomer and contains the elastic membrane.

8. The dispenser with the elastic membrane for sachets, according to claim 1, wherein the body of the dispenser comprises the elastic top region appointed above the screw thread with a circular overlay of the inner surface and contains the elastic membrane of a concave meniscus.

9. The dispenser with the elastic membrane for sachets, according to claim 1, wherein the body of the dispenser comprises caveats/depressions situated on the external side of the pouring nozzle in the upper region but below the tip, wherein the caveat comprises creases/bumps that pose a larger surface area than if the creases were not present by a factor of at least 1, wherein the caveat contains at least one perforation through the entire wall thickness; wherein a second material in form of thermoplastic elastomer or liquid silicone rubber bonds with a first material polyethylene or polypropylene in the area of the caveat and perforations, and wherein the dispenser contains a vertical channel connecting the elastic upper region with the top of the dispenser.

10. The dispenser with the elastic membrane according to claim 1 comprising a caveat/depression situated on the external side of the pouring nozzle in the upper region but below the tip.

11. The dispenser with the elastic membrane according to claim 1 comprising a caveat situated less than 2 cm below the tip of the dispenser and having at least 0.5 mm in total height and less than 1.5 mm in thickness.

12. The dispenser with the elastic membrane according to claim 1 comprising a caveat having a rougher surface finish than rest of the dispenser by a factor of at least 1.

13. The dispenser with the elastic membrane according to claim 1 comprising a caveat with creases/bumps that have a larger surface area by a factor of at least 1 than if the creases were not present like when being shaped as a flat, straight surface/edge.

14. The dispenser with the elastic membrane according to claim 1 comprising a caveat which contains at least one perforation through the entire wall thickness—a hole right through the spout—wherein each perforations has an area greater than 01 $mm^2$ but less than 100 $mm^2$, wherein the area of the inner side of the spout near the perforations has a rougher surface than the rest of the spout by a factor of at least 1.

15. The dispenser with the elastic membrane according to claim 1 comprising the elastic membrane made of thermoplastic elastomer (TPE) or liquid silicon rubber (LSR) materials, which is bonded to the dispenser in the area of the dispensers' caveat/depression and perforations.

16. The dispenser with the elastic membrane according to claim 1 comprising the elastic membrane with a thickness of no more than 2 mm.

17. The dispenser with the elastic membrane according to claim 1 which is entirely made by a multi component injection moulding process in index plate technology.

18. The dispenser with the elastic membrane according to claim 1 which is entirely made by a multi component injection moulding process in turntable technology.

19. The dispenser with the elastic membrane according to claim 1 which is entirely made by a multi component injection moulding process in stack turning injection moulding technology.

20. The dispenser with the elastic membrane according to claim 1 which is entirely made by a multi component injection moulding process in cube injection moulding technology.

* * * * *